United States Patent [19]

Lum

[11] 4,382,621

[45] May 10, 1983

[54] DOOR LATCH

[75] Inventor: Albert C. H. Lum, Honolulu, Hi.

[73] Assignee: D.S.L. Inc., Honolulu, Hi.

[21] Appl. No.: 160,282

[22] Filed: Jun. 17, 1980

Related U.S. Application Data

[63] Continuation-in-part of Ser. No. 106,012, Dec. 21, 1979, Pat. No. 4,311,330.

[51] Int. Cl.[3] ..... E05C 3/04

[52] U.S. Cl. ..... 292/210; 292/298

[58] Field of Search ..... 292/210, 290, 291, 296, 292/297, 298, 244

[56] References Cited

U.S. PATENT DOCUMENTS

| | | | |
|---|---|---|---|
| 281,174 | 7/1883 | Briggs et al. | 292/114 |
| 800,007 | 9/1905 | Niles | 292/296 |
| 892,462 | 7/1908 | Stewart | 292/297 |
| 960,521 | 6/1910 | Early | 292/298 |
| 970,273 | 9/1910 | Sorrow | 292/297 |
| 1,065,965 | 7/1913 | Palmer et al. | 292/297 |
| 4,311,330 | 1/1982 | Lum | 292/210 |

*Primary Examiner*—Richard E. Moore

*Attorney, Agent, or Firm*—Littlepage & Webner

[57] ABSTRACT

Rigid with a plate mounted on a door jamb is an inward extension, on the free end of which is pivoted a latch which swings between door-blocking and door-unblocking positions. The latch is releasably retained in door-blocking position by a flat strip having one end pivoted to the latch and a free end engageable between the door and the door jamb. The latch also has an intermediate position which permits the door to be cracked open.

4 Claims, 11 Drawing Figures

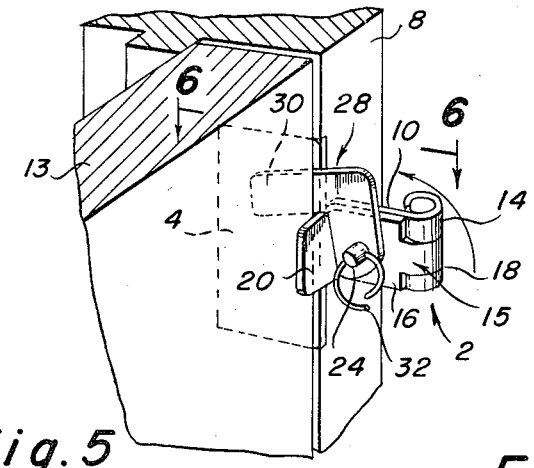
Fig. 5
Fig. 6
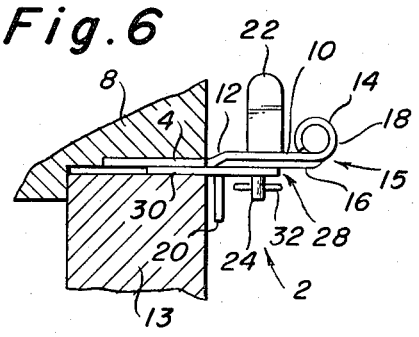
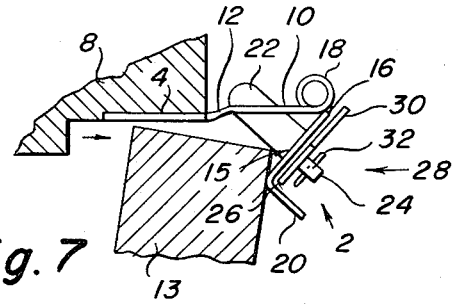
Fig. 7
Fig. 8
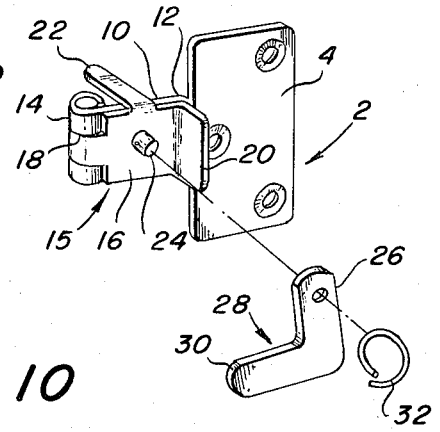
Fig. 10
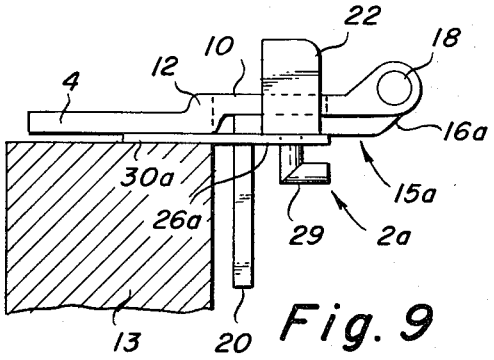
Fig. 9
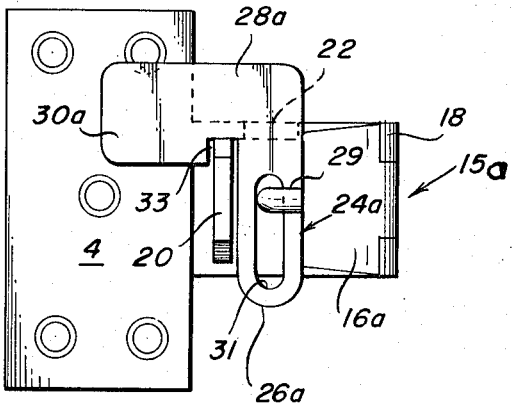
Fig. 11
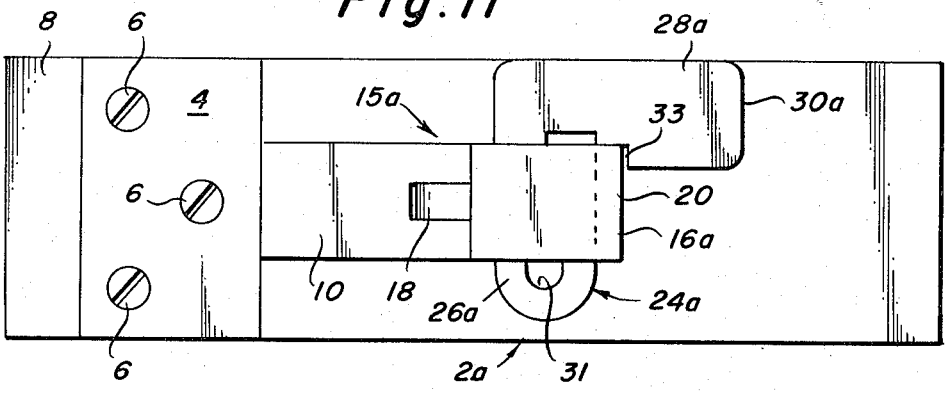

DOOR LATCH

RELATED APPLICATION

Lum, Ser. No. 106,012, filed Dec. 21, 1979, DOOR LATCH, now U.S. Pat. No. 4,311,330 of which this is a continuation-in-part.

FIELD OF INVENTION

Closure Fasteners, Portable Securing Plate or Bar, Swinging Holding Member.

OBJECTS

The primary object of this invention is to provide a door latch which can be easily and quickly changed between latching and unlatching condition; and which, in its latching position, mechanically blocks the door against opening, and which cannot be forced to its unlatching position without positive manipulation of a latch-retaining member.

Another object is to provide a door latch of the foregoing characteristics which retains itself in an intermediate position so as to permit the door to be cracked open.

Still another object is to provide a door-blocking latch which, by selective orientation of a latch-retaining member, can be adapted to either a left-hand in-swinging door or a right-hand in-swinging door.

A further object is to provide a latch retainer which requires deliberate manipulation from the in-side of a door in order to disable the door-blocking member.

These and other objects will be apparent from the following specification and drawings, in which:

FIG. 5 is a view comparable to FIG. 3 showing the latch in door-blocking position and the retaining member engaged;

FIG. 6 is a fragmentary cross-section along the line 6—6 of FIG. 5;

FIG. 7 shows the first form of the latch arranged for permitting partial opening of the door;

FIG. 8 is an exploded view illustrating the adaptability of the latch for a left-hand in-swinging door;

FIG. 9 is a view comparable to FIG. 6, but showing in plan view a modified form of the latch;

FIG. 10 is a side elevation of the modified form of the latch removed from the door, illustrating the action of the slot and notch in the latch retainer; and FIG. 11 is a side elevation of the modified form showing the latch open.

Figure 1:
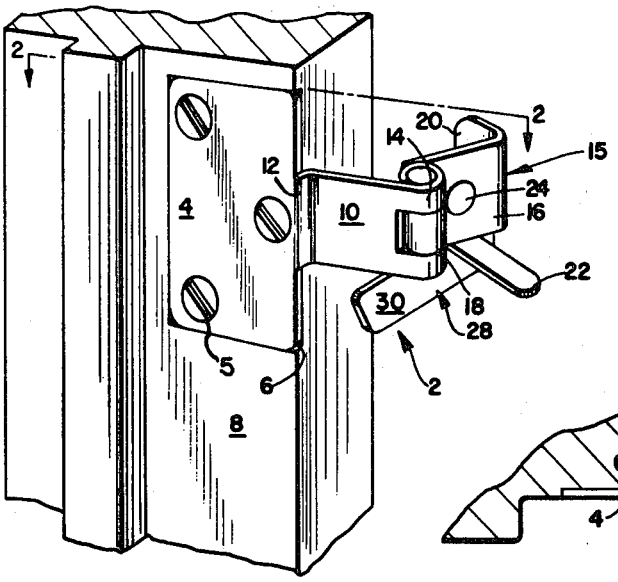
FIG. 1 is a perspective view of a first form of the latch installed on a door jamb.

Referring first to the drawings, in which like reference numerals denote similar elements, the first form of the door latch 2 is show is shown in FIGS. 1–7 as it is used on a right-hand in-swinging door. The latch consists of a plate 4 fastened as by screws 5, into a notch 6 so that it lies flush with the door jamb 8. Integral with plate 4 is an inward extension 10 which is offset as at 12 to provide clearance for the door 13. On the outer end 14 of extension 10 a latch 15, an arm 16 of which is pivoted as at 18 to the extension. On the free end of arm 16 is a right-angle flange 20 which, as will be explained hereinafter, is the door blocking member. An elongate tab 22, which extends in the opposite direction from flange 20, is integrally formed on arm 16.

On one side of arm 16 is a pintle 24 to which one arm 26 of a latch retainer 28 is pivoted. Retainer 28, which is an L-shape flat strip, has another arm 30 at right angles to arm 26, whose function will be apparent hereinafter. The retainer is removably retained on pintle by a spring ring 32.

Figure 2:
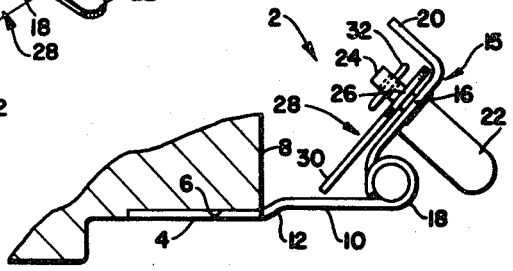
FIG. 2 is a fragmentary cross-section along the line 2—2 of FIG. 1.
Figure 3:
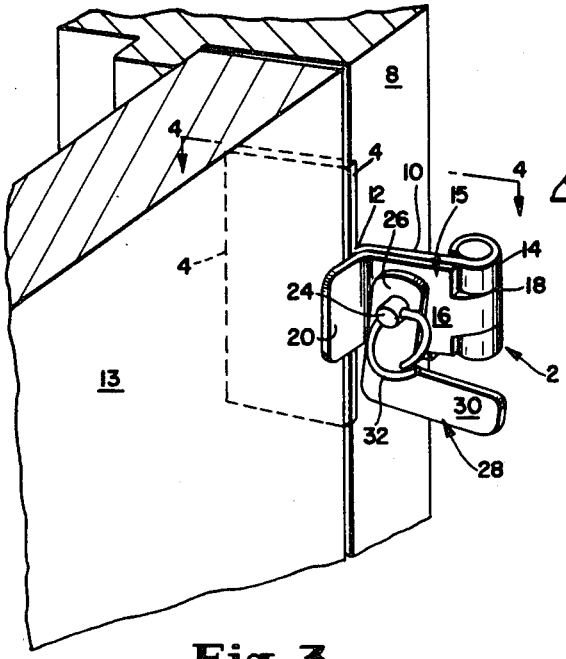
FIG. 3 is a view comparable to FIG. 1 showing the latch in door-blocking position but with the retaining member yet to be engaged.
Figure 4:
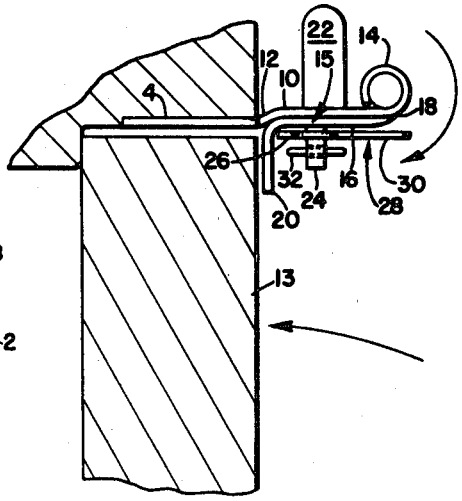
FIG. 4 is a fragmentary cross-section along the line of 4—4 of FIG. 1.

In operation the latch is swung to its FIG. 1 and FIG. 2 position, door 13 is closed, and the latch 15 is swung about its pivot 18 so as to engage the flange 20 against the inner side of door 13, and in the swing path thereof. Thereafter retainer 28 holds latch 15 and prevents it from swinging. Thus the flange 20 is retained firmly in the door-blocking position of FIG. 5 and FIG. 6.

If it is desired to permit the door to be cracked open, the retainer 28 may be swung back so as to permit latch 15 to pivot slightly, and when the door is partly opened, its corner engages against arm 10 and swings it counterclockwise, as is seen in FIG. 7, for about 45°, but it cannot swing it further because the door corner is trapped between tab 22 and flange 20. Hence, the door is blocked against opening further inwardly from its cracked position until the door is re-closed and the latch is swung clear from the swing path of the door as in FIG. 1.

If the latch is to be used for a left-hand in-swinging door, spring ring 32 is removed from pintle 24, retainer 28 is reversely oriented to the position illustrated in FIG. 8, and the assembly is inverted so as to place the tab 22 on the upper side of arm 10.

The first form of the latch described hereinbefore is the subject matter of patent application Ser. No. 106,012 (supra). The improvement embodied in the modified form is shown in FIGS. 9, 10 and 11 wherein the elements similar to those previously described are designated with the same reference numerals and the modified elements are designated with the same numerals as used for comparable elements previously described, plus the suffix "a".

As in the previous embodiment, the door latch **2*a* has a plate 4 fastened by screws 6 to a door jamb 8. Integral with the plate 4 is an inward extension 10 which is offset at 12 to provide clearance for the door 13, and on the outer end of the extension is a latch 15*a*. Latch 15*a* consists of an arm 16*a* pivoted as at 18 to extension 10. On the free end of arm 16*a* is a right-angled flange 20, the door-blocking function of which has been previously described. A tab 22 on the top of arm 16*a* cooperates with flange 20** to trap the door in partly-open condition as previously described.

The improvement of this modification resides in the latch retainer **28*a*. Retainer 28*a* is an L-shape strip, one arm 26*a* of which is supported on door arm 16*a* by a sliding pivot 24*a*, which pivot consists of an L-shape pin 29 rigidly affixed on arm 16*a*, and slidably engaging in a elongate slot 31 disposed in the arm 26*a* of the latch retainer 28*a*. The other arm 30*a* of the latch retainer 28*a* has a slot 33 which engages over the door-blocking flange 20** so as to prevent dislodgement of the latch retainer other than by deliberate manipulation from the inside of the door.

In operation, when the door is closed, latch **15*a* is pivoted to its door-blocking position and latch retainer 28*a* is swung so as to engage its arm 30*a* between the door 13 and door jamb 8, and slot 33 is engaged over flange 20**. The modification then functions in the same manner as the first embodiment previously described.

I claim:

1. A door latch, comprising:

a mounting plate adapted to be secured against the frame of an inwardly-opening door and an extension adapted to extend inwardly away from the door frame, a latch comprising an arm having one end pivoted to the mounting plate extension and a flange on the opposite end thereof, said latch being pivotal between a normal door-blocking position in which said arm lies adjacent said plate expansion and said flange is disposed in the swing path of the door, and a door-unblocking position in which said flange lies clear of the swing path of the door, and a latch retainer comprising a flat strip having one end connected to said arm and another end removably engageable between the door edge and the door frame, thereby preventing pivotal movement of the latch to its door-unblocking position, said latch retainer being substantially L-shape, said one end thereof being one leg of the L and the mounting thereof on said latch arm being a pivot, the other end of the latch retainer being the other leg of the L, The latch arm and flange being of flat plate material and the flange extending at substantially 90° with respect to the latch arm, the pivotal mounting of said latch retainer comprising a pintle extending outwardly from the latch arm in the same direction therefrom as the flange, said one leg of said latch retainer having a hole through which said pintle engages.

2. A door latch as claimed in claim 1, and means for releasably retaining said latch leg on said pintle whereby the orientation of the other leg of the latch retainer may be reversed to accommodate the latch to either a left-hand or a right-hand door.

3. A door latch as claimed in claim 1, and interengaging means on said latch retainer and said latch for releasably holding said latch retainer in retaining engagement with said latch.

4. A door latch as claimed in claim 1, said pivot being a sliding pivot providing sliding movement of said latch retainer in the lengthwise direction of said leg of the L, the other leg of the L having notch means therein for engaging over the flange of the latch.

* * * * *